US005887753A

United States Patent [19]

Poolman

[11] Patent Number: 5,887,753

[45] **Date of Patent: *Mar. 30, 1999**

[54] PRETREATING DISPENSING DEVICE HAVING A FREELY ROTATING BALL CAPABLE OF ROTATING IN ALL DIRECTIONS

[75] Inventor: Gerard Charles Poolman, Strombeek-Bever, Belgium

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 732,363

[22] PCT Filed: Apr. 18, 1995

[86] PCT No.: PCT/US95/04739

§ 371 Date: Oct. 25, 1996

§ 102(e) Date: Oct. 25, 1996

[87] PCT Pub. No.: WO95/29121

PCT Pub. Date: Nov. 2, 1995

[30] Foreign Application Priority Data

Apr. 27, 1994 [EP] European Pat. Off. ..... 94870073

[51] Int. Cl.[6] ..... B67B 7/00

[52] U.S. Cl. ..... 222/1; 222/494; 68/17 R; 68/96; 401/186; 401/209; 401/316

[58] Field of Search ..... 222/1, 212, 494; 401/183, 186, 263, 265, 266, 209, 216; 68/17 R, 96

[56] References Cited

U.S. PATENT DOCUMENTS

| | | | |
|---|---|---|---|
| 2,968,826 | 1/1961 | Leshin | 401/209 |
| 4,241,852 | 12/1980 | Klem | 222/103 |
| 4,703,872 | 11/1987 | Cornette et al. | 222/158 |
| 4,889,441 | 12/1989 | Tice | 401/131 |
| 5,341,660 | 8/1994 | Berveglieri | 68/17 R |
| 5,355,541 | 10/1994 | Rutter et al. | 8/158 |
| 5,379,919 | 1/1995 | Gueret | 222/105 |
| 5,388,298 | 2/1995 | Rutter et al. | 8/158 |

*Primary Examiner*—Gregory I. Huson
*Attorney, Agent, or Firm*—Elizabeth M. Koch

[57] ABSTRACT

A dosing and dispensing device for liquid detergent has a hollow body and a dispenser. The hollow body has an opening for receiving liquid detergent. The dispenser spreads the liquid detergent onto a fabric to pretreat the fabric. The dispenser has a cavity and a ball positioned within the cavity. The cavity has a mouth, lips, and an orifice. The ball is retained by the lips and communicates with the orifice. The diameter of the mouth is at least slightly smaller than the diameter of the ball such that the ball protrudes partly outside of the mouth. In addition, the ball rotates freely in all directions within the cavity.

8 Claims, 1 Drawing Sheet

PRETREATING DISPENSING DEVICE HAVING A FREELY ROTATING BALL CAPABLE OF ROTATING IN ALL DIRECTIONS

FIELD OF THE INVENTION

The present invention relates to a dosing and dispensing device for liquid laundry detergents. The device according to the present invention is particularly adapted to pretreat fabrics with a portion of liquid detergent.

BACKAGROUND OF THE INVENTION

Dispensing devices for liquid detergent, which are to be introduced with the fabrics in the washing machine, are well known in the prior art. It is also known that it is possible to achieve a greater effectiveness in respect of stain removal by pretreating the fabrics with the liquid detergent. Pretreatment means that a certain amount of detergent is applied directly onto the dirty parts of said fabrics before they are washed in the machine. The devices in the prior art adapted to pretreat are generally dispensing devices with a spreader of liquid detergent for pretreatment purposes. In the following detergent means a detergent composition for the treatment of fabrics. This detergent composition may comprise washing additives, like bleaches, enzymes and/or others known in the art.

We found that a pretreatment spreader has to provide certain features to maximize the pretreatment performance. Such an important feature is a controlled multi-directional spreading. "Multi-directional spreading" means that the spreading is not bound to act in a predetermined direction, but it is always completely free to change the spreading direction. This ensures a comfortable spreading of the liquid detergent even on very complicated patterns of stains, without the need for the user to perform complicated movements with his hand. In this manner the spreading is also better controlled, and therefore avoids waste of liquid detergent, since it is easier to spread with accuracy only on the limited area of the stain.

Various pretreatment devices for liquid detergent are described in the prior art, for example in U.S. Pat. Nos. 5.388,298 and 5,355,541. The pretreatment devices of U.S. Pat. No. 5,355,541 have predetermined outlets. The liquid detergent is spreaded and then rubbed on the areas of the fabrics through irregularities on the external surface of the pretreatment device itself. In this manner the application of the liquid detergent on the fabrics can not be performed with an accurate control of the direction.

One of the removable pretreatment applicators disclosed in WO 92/09737 is generically a ball. It is not specified in which direction said ball rotates. Furthermore, this ball applicator is in fact a separate piece from the dispensing device. This means that to pretreat the user has to hold the filled dosing device in one hand and the ball applicator in the other which renders the pretreatment very complicated. Furthermore, the ball applicator has to be dipped from time to time into the filled dosing device to keep the ball always wet enough for the pretreatment.

Another approach is represented by U.S. Pat. No. 5,341, 660. A circular-sectioned applicator acts as a spreader of the liquid detergent onto the fabrics. Said applicator rotates about opposite pins engaged in the rim of said orifice. Said applicator is able to apply the liquid detergent flowing out of the orifice on a surface by rotating about the axis defined by the pins. A predetermined axis of rotation is therefore defined by these opposite pins. This does not allow a controlled multi-directional spreading of the liquid detergent in the pretreatment.

It is therefore an object of the present invention to provide a dosing and dispensing device adapted to pretreat fabrics with a spreader acting in a controlled multi-directional manner.

It is another object of the present invention to provide a process for pretreating and washing fabrics in a washing machine with the dosing and dispensing device herein described.

We have now found that this could be achieved by designing a pretreatment device with a "roller ball", i.e. a ball which rotates in all directions.

SUMMARY OF THE INVENTION

The present invention is a dosing and dispensing device for liquid detergent which can be introduced in a washing machine with the fabrics. Said device comprises a hollow body, an opening and means to spread at least a portion of the contained liquid detergent onto a surface of fabrics. This means comprises an orifice which lets the contained liquid detergent communicate with a ball. Said ball rotates freely in all directions.

DETAILED DESCRIPTION OF THE INVENTION

Figure 1:
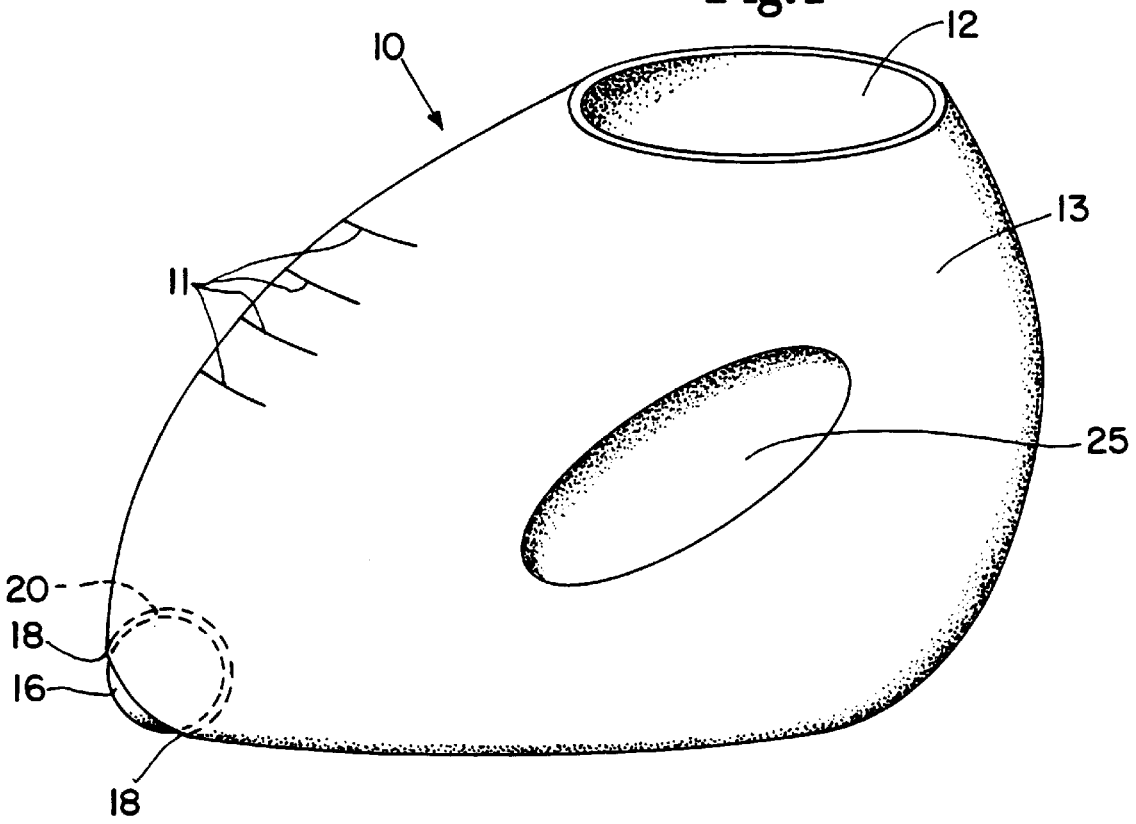
FIG. 1 shows the preferred embodiment of the dosing and dispensing device of the present invention adapted to pretreat fabrics.

The present invention is a pretreatment device for containing liquid substances. An embodiment of the device is shown in FIG. 1. The pretreatment device (10) comprises a hollow body (13), an opening (12), an orifice (FIG. 2, 14), and a ball (16). The orifice (FIG. 2, 14) and the ball (16) form the pretreatment means. In the following "horizontal" means a direction or a plane parallel to the supporting basis of the pretreatment device in its upright position.

The hollow body (13) may be made of any material resistant to water and also to weak alkalines/acids, withstanding the temperatures reached in the washing machines. In particular, for temperatures up to 95° C. For example it is possible to use plastic materials, such as polyethylene, polypropylene, polyurethane, or any other similar material. Preferably said devices are transparent to allow a visible measuring and dosing of the liquid detergent into said devices. To facilitate the measuring and dosing, the device preferably comprises on the external and/or internal surface of the hollow body at least a dosing line (11).

The hollow body may be also deformable at least by the mechanical agitation during the wash cycle and resilient to regain its original shape after any deformation. This compression/springback helps wash liquid to enter in the hollow body of the device, and therefore a better dilution of the liquid detergent within the device is achieved even when said detergents are considered difficult to dispense by virtue of viscosity.

Through the opening (12) the filling of the device with the liquid detergent is achieved. When this device is put inside the washing machine with the fabrics, it also allows the dispensing of the liquid detergent into the wash liquid of the machine during the wash cycle. Several filling and dispensing openings on one device are also possible. The dimensions of the openings (12) can be chosen by any person skilled in the art. The openings are preferably permanently open. They can be also subdivided in predetermined outlets or closable as described for example in EP-A-339 197.

The orifice (FIG. 2, 14) brings in communication the contained liquid (FIG. 2, 19) with the ball (16). The dimensions and the shape of said orifice can be chosen by any person skilled in the art. The orifice can be permanently open, or it can be a slit which opens progressively upon squeezing on the hollow body of the device and closes again when the squeezing stops. With the slit the leakage tightness can be improved and the amount of liquid detergent coming in contact with said ball (16) can be better adjusted by the user. In the case of a slit, the device must be made of a deformable and resilient material. The pretreatment device of the present invention may have a single permanently open orifice or slit, but also several orifices or slits are possible in one device. Orifices and slits as defined before may be also combined in one device.

The ball (16) may be made of any water resistant material, withstanding also the temperatures reached in the washing machines. The present invention is not limited to a single ball; several balls for a single device are also possible. For example it is possible to use plastic materials, such as polyethylene, polypropylene, polyurethane, or any other similar material used also for the hollow body. The surface of said ball can be rough or smooth.

As said before the ball (16) has to come in contact with the contained liquid through the orifice (14) and has to have the possibility to rotate freely in all directions when spreading the liquid detergent during pretreatment. This can be accomplished in the following way referring also to FIG. 2. As schematically illustrated, the ball (16) is partially located in the volume (20) part of the hollow body (13) of the device (10). This volume (20) has two openings: the mouth (FIG. 1, 18) and the orifice (14). The ball protrudes at least partially from the mouth (18). The lip (23) of the mouth (18) holds the ball inside the mouth. The dimensions of the ball (16) and the dimensions of the mouth (18) are tuned one to each other so that the ball is not able to exit completely through the mouth. This means that the diameter of the mouth is at least slightly smaller than the diameter of the ball. In this manner, the ball is free to rotate about any axis inside the volume (20).

The liquid tightness is ensured by the hydrostatic pressure of the liquid contained in the device (10) which pushes the ball to the lip (23) of the mouth (18). In this manner any gap is closed between said ball and the mouth achieving a leakage-free device.

The ball held in this manner is not bound to act in predetermined directions. This is due to the fact that said ball is able to rotate about any possible axis, since the described holding method of said ball does not introduce any constraints. This allows a more even spreading of the liquid detergent in all possible directions. The movement of the ball upon the pretreated surface facilitates also the foaming of the spreaded liquid detergent on any type of surface, even delicate surfaces, like silk.

The pretreatment means described so far allows a controlled multidirectional spreading, i.e. a spreading which is not bound to act in a predetermined direction, but it is always completely free to change the spreading direction. This feature is particularly useful to achieve an accurate and comfortable spreading of liquid detergent, ensured also on very complicated patterns of stains. Otherwise the user would be obliged to perform complicated movements with his hand, like twisting the wrist. In this manner the spreading is also better controlled, and therefore avoids waste of liquid detergent, since it is easier to spread only on the limited area of the stain.

The ball (16) is manufactured separately from the hollow body (13). This ball can be inserted in the volume (20) by simply pushing said ball through the mouth (18). This is possible, since the lip (23) of the mouth is flexible enough to be elastically deformed, at least slightly, since said mouth, part of the hollow body, is preferably made of a plastic material. Another possibility is to mould the hollow body holding or suspending the ball in a space which will become the volume (20). The device (10) can also comprise more than one ball (16), holded separately or in a common mouth (18).

Figure 2:
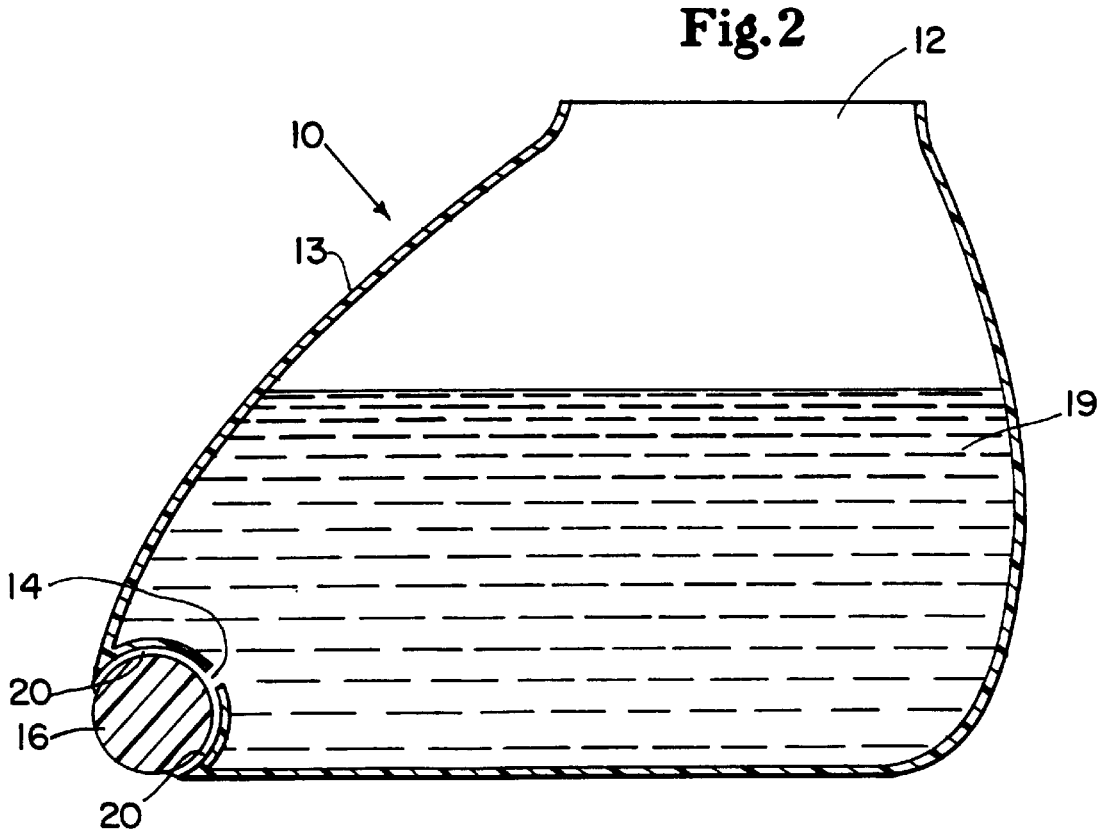
FIG. 2 illustrates a cross sectional view of the embodiment of FIG. 1.

In both FIGS. 1 and 2 the pretreatment means are located in the bottom part of the device (10), with the opening (12) being on the top part of the same device. The pretreatment means being in the bottom part of the device (10) means that the level of the contained liquid detergent (19) is always above the orifice (14). The orifice (14), as explained before, allows the communication between the contained liquid (19) and the ball (16). The location of the orifice (14) on the internal wall (21) of the volume (20) can be selected by any person skilled in the art. For the device (10) of FIG. 1 and 2, the contained liquid automatically flows inside the volume (20) intercepting the ball (16), since the minimum liquid detergent level is always higher than the orifice (14).

This means that the liquid detergent needs not to be poured into the orifice, therefore the device remains in a horizontal position during the pretreatment operation allowing an easy measuring and/or controlling of the amount of liquid detergent applied onto the fabrics during the pretreatment. The measuring and/or controlling can be further facilitated by the dosing lines (11). Nevertheless, the pretreatment means can be easily located on the top part of device nearby the opening (12).

Gripping means (FIG. 1, 25) can also be provided in the form of cavities, depressions or striations on the external surface of the hollow body (13). They facilitate in holding or even squeezing the device for the pretreatment. This type of means is easy to produce during the moulding of the body of the device. Specific dimensions or shapes of the device in general can be selected by any person skilled in the art.

A process comprising the following steps, which desribe the pretreating and washing of fabrics in a washing machine with the dosing and dispensing device according to the present invention, is provided:

a dose of the total quantity of liquid detergent to be utilized during the pretreatment and washing cycle is introduced into the dosing and dispensing device;

pretreatment of the fabrics is executed with a controlled quantity of the liquid detergent dosage contained in said device and dispensed from said device through that cut;

the thus pretreated fabrics are placed in the drum of the washing machine together with said dosing and dispensing device and with other non-pretreated fabrics.

I claim:

1. A dosing and dispensing device for liquid detergents comprising a hollow body having an opening; and dispensing means to spread at least a portion of the contained liquid detergent onto fabrics, said dispensing means comprising:

a cavity having a mouth, lips, and at least one orifice; and a ball retained within said cavity by said lips and communicating with said at least one orifice, wherein the diameter of said mouth is at least slightly smaller than the diameter of said ball, said ball rotating freely in all directions within said cavity.

2. The device of claim 1, wherein said at least one orifice can be a reclosable slit which opens upon squeezing the device, and closes when the squeezing stops.

3. The device of claim 1, wherein said dispensing means is located in the bottom part of the device.

4. The device of claim 1, wherein a portion of said ball is held between said mouth of said at least one orifice, and said ball protrudes partly outside of said mouth.

5. The device of claim 1, further comprising dosing lines on said hollow body.

6. The device of claim 1, further comprising gripping means on said hollow body.

7. The device of claim 1, wherein the device is made of plastic material.

8. A process for pretreating and washing fabrics in a washing machine with the dosing and dispensing device of claim 1, comprising the following steps:

a) a dose of the total quantity of liquid detergent to be utilized during the pretreatment and washing cycle is introduced into the dosing and dispensing device through said opening;

b) pretreatment of the fabrics is executed with a controlled quantity of the liquid detergent dosage contained in said device and dispensed from said device through said orifice wherein said ball rotates freely in all directions within said cavity to evenly spread the liquid detergent in all possible directions; and c) the thus pretreated fabrics are placed in the drum of the washing machine together with the dosing and dispensing device and with other non-pretreated fabrics.

* * * * *